United States Patent [19]

Inagaki et al.

[11] Patent Number: 4,812,873

[45] Date of Patent: Mar. 14, 1989

[54] HEAT FIXING UNIT IN AN ELECTROPHOTOGRAPHIC COPYING APPARATUS

[75] Inventors: Sanji Inagaki; Hiroshi Fukao, both of Toyokawa; Tetsuya Yamada, Aichi; Etsuaki Urano; Yoshihiro Hattori, both of Toyokawa, all of Japan

[73] Assignee: Minolta Camera Kabushiki Kaisha, Osaka, Japan

[21] Appl. No.: 93,314

[22] Filed: Sep. 4, 1987

[30] Foreign Application Priority Data

Sep. 9, 1986 [JP] Japan ..... 61-212424
Mar. 17, 1987 [JP] Japan ..... 62-38967

[51] Int. Cl.[4] ..... G03G 15/20
[52] U.S. Cl. ..... 355/3 FU; 355/14 FU; 219/216
[58] Field of Search ..... 355/3 FU, 14 FU; 219/216, 469, 470; 432/60, 228

[56] References Cited

U.S. PATENT DOCUMENTS 4,200,389 4/1980 Matsui et al. ..... 355/3 FU
4,321,033 3/1982 Eddy et al. ..... 432/60

FOREIGN PATENT DOCUMENTS 63738 4/1976 Japan .

*Primary Examiner*—A. C. Prescott
*Assistant Examiner*—Jane Lau
*Attorney, Agent, or Firm*—Burns, Doane, Swecker & Mathis

[57] ABSTRACT

A heat fixing unit in an electrophotographic copying apparatus is disclosed. The heat fixing unit comprises a heat fixing roller with a heater, a pressure roller with a plurality of fibers, and driven ring components disposed on the ends of the pressure roller for adjusting the contact amount between the heat fixing roller and the pressure roller. The heat fixing unit offers a less warming up time and a better paper delivery performance, and requires less material cost.

The heat fixing unit in an electrophotographic copying apparatus may employ a fixed type or a rotary type curing unit for raising the plurality of fibers.

10 Claims, 10 Drawing Sheets

PRIOR ART

HEAT FIXING UNIT IN AN ELECTROPHOTOGRAPHIC COPYING APPARATUS

BACKGROUND OF THE INVENTION

1. Field of the Invention

The present invention relates to a heat fixing unit in an electrophotographic copying apparatus.

2. Description of the Prior Art

The conventional heat fixing unit in an electrophotographic copying apparatus has a heat fixing roller 30*a* and a pressure roller 40*a* as shown in FIG. 16.

The heat fixing roller 30*a* and the pressure roller 40*a* nip both sides of a copying paper 20*a* with toner images 10*a* formed on one of its surfaces. The heat fixing roller 30*a* and the pressure roller 40*a* deliver the copying paper, heat and supply pressure to the toner images 10*a* in order to fix the toner images 10*a* on the copying paper 20*a*.

3. Problems with the Prior Art

The conventional heat fixing unit fixes the toner images 10*a* on the copying paper 20*a* by pressing the copying paper 20*a* and the toner images 10*a* hard against the heat fixing roller 30*a* with the pressure roller 40*a* contacting with the reverse surface of the copying paper 20*a*, which is opposite to the toner images 10a formed surface, and by heating the copying paper 20*a* and the toner images 10*a* with the heat fixing roller 30*a*. The pressure roller 40*a* employs a material having a larger elasticity than that of the heat fixing roller 30*a* in order to increase the fixing time by widening the nip width of the copying paper 20*a* in relation to the heat fixing roller 30*a*. For instance, the pressure roller 40*a* employs a rubber roller. Consequently, the conventional heat fixing unit in an electrophotographic copying apparatus has the following problems:

It is necessary to increase the strength of retaining plates for retaining the pressure roller 40*a* because the pressure roller 40*a* is brought into contact with the heat fixing roller 30*a* by the large force of approximately 1.5 kgf/cm. (Pressure, force or pressing force means the force per axial length of a roller in this specification. The total pressing force means the product of the pressing force and the axial length of a roller.) It is a also necessary to increase the strength of the heat fixing roller 30*a* and the pressure roller 40*a* themselves.

As the area of the pressure roller 40*a* contacting with the heat fixing roller 30*a* is large in the conventional heat fixing unit, a large quantity of heat escapes from the heat fixing roller 30*a* to the pressure roller 40*a*. Accordingly, it is required to prolong the warming up time for the heat fixing unit in the initial stage of the electrophotographic copying apparatus operation, and it is also required to heat and keep the heat fixing roller 30*a* at a high temperature. As a result, the quality of the copying paper 20*a* is liable to change during the delivery between the heat fixing roller 30*a* and the pressure roller 40*a*; i.e. many wrinkles are liable to occur because a large quantity of water is removed from the copying paper 20*a*. Hence, the copying paper 20*a* tends to curl.

When fixing at high pressure, the bonding force between the heat fixing roller 30*a* and the toners forming the toner images 10*a* increases. Consequently, it is hard to separate the copying paper 20*a* from the heat fixing roller 30*a*.

SUMMARY OF THE INVENTION

1. Object of the Present Invention

It is a major object of the present invention to improve the contacting condition between the heat fixing roller and the pressure roller in the conventional heat fixing unit in which the heat fixing roller and the pressure roller are brought into contact by the large force.

2. Means to Solve the Problems

The present invention provides the following means to solve the above mentioned problems; i.e. a heat fixing unit in an electrophotograhic copying apparatus according to the present invention comprises the following:

a rotatable heat fixing roller having heating means;

a rotatable pressure roller disposed in contact with said heat fixing roller having a column shape core and a plurality of fibers disposed on the periphery surface of said core; and an adjustment means for adjusting the contact amount of said fibers in relation to the periphery surface of said heat fixing roller.

The heat fixing roller may employ a conventional configuration: a metal cylinder, for instance an aluminum cylinder, having a teflon (a registered trademark) coated layer on the outer periphery thereof and a heater disposed inside thereof.

The periphery of the pressure roller for applying pressure to the copying paper is formed of a brush with a plurality of extending fibers.

The flexibility of the brush and the pressing force of the brush against the copying paper can be set at will by selecting the material, diameter and length of the plurality of fibers forming the brush, number of fibers per unit area and so on.

The brush should preferably be formed of a material resistible to the heat from the heat fixing roller. For instance, it may employ a metal brush, an aromatic polyamide resin brush, a fluoro resin brush. In case it employs a metal brush, the tip surfaces of the plularity of the metal fibers forming the brush should preferably be coated with a coating agent offering a good separability. The brush may be formed of a material with a conductive additive. If such is the case, the copying paper winding over the heat fixing roller due to the charged heat fixing roller can be made less likely to occur. The brush may be formed in a roll shape, a crown shape or a reverse-crown shape to deliver the copying paper stably.

The pressure roller may be rotatably retained by retaining plates supporting the rotary shaft of the pressure roller, and the pressure roller and the heat fixing roller may be driven compulsorily. The diameter of the both ends of the pressure roller may be slightly larger than that of the brush portion of the pressure roller contacting with the heat fixing roller, so that the both ends of the pressure roller are brought into contact with the both ends of the heat fixing roller, and so that the pressure roller may be driven by the heat fixing roller.

The pressure roller may be manufactured by winding a flexible plate-shape substrate, having a plurality of flocked fibers, over the outer periphery of a column shape roller or a cylinder shape roller and by applying an adhesive and the like therebetween.

The heat fixing unit may have a curing unit for raising the brush disposed in parallel to the pressure roller. The curing unit is brought into contact with the brush and raises the brush having contacted with the heat fixing roller. In case the heat fixing unit employs the curing unit, the brush having contacted with the heat fixing roller and leaned in one direction can be raised to a desired angle. Thus the brush can always be brought into contact with the heat fixing roller in a constant inclined angle, and the brush action against the copying paper can be stabilized. The curing unit may employ a fixed type unit or a rotary type unit.

3. Operations of the Present Invention

The pressure roller of the heat fixing unit in an electrophotographic copying apparatus according to the present invention has the periphery for applying pressure to the copying paper. The periphery of the pressure roller for applying pressure to the copying paper is formed of a brush with a plurality of extending fibers.

When the heat fixing unit is operated, the copying paper is nipped by the heat fixing roller and the pressure roller, and the copying paper is delivered by the same. Thus the toner images formed surface of the copying paper is brought into contact with the heat fixing roller by low pressure exerted by the elasticity of the brush contacting and applying pressure to the reverse surface of the copying paper opposite to the toner images formed surface. Consequently the toner images formed surface of the copying paper is brought into contact with the periphery of the heat fixing roller in a wider nip width as well as in lower pressure than the pressure exerted by the conventional pressure roller.

When the electrophotographic copying apparatus is instructed to start the copying operation, a less quantity of heat escapes from the heat fixing roller to the pressure roller, and the heat fixing roller temperature drop becomes less since the heat fixing roller and the pressure roller contact with each other in a smaller nip area. Since the brush configuration reduces the contacting area, it is useful to stablize the toner image fixing on the copying paper in the initial stage of the heat fixing unit operation.

4. Advantages of the Present Invention

When the pressure roller rotates while being brought into contact with the heat fixing roller and the copying paper is nipped and delivered between the pressure roller and the heat fixing roller, the toner images formed on the surface of the copying paper is brought into contact with the outer periphery of the heat fixing roller by the brush contacting with the reverse surface of the copying paper, opposite to the toner images formed surface, and a larger nip width can be obtained by the elastic force of the brush under low pressing force condition. Therefore the heat fixing unit in an electrophotographic copying apparatus according to the present invention provides the following advantages:

(1) The heat fixing roller should be heated to high temperature necessary to fix the toner images on the copying paper immediately after the electrophotographic copying apparatus has been turned on. In accordance with the present invention, less quantity of heat escapes from the heat fixing roller to the pressure roller as the result of the heat conduction, and the temperature drop of the heat fixing roller can be prevented from taking place. Consequently, it is possible to reduce the time required to warm up the electrophotographic copying apparatus.

(2) Since the nip width has been enlarged, the heat generated by the heat fixing roller can be conducted to the toner images on the copying paper effectively, and it is possible to set the desired temperature of the heat fixing roller for obtaining the predetermined fixing strength at lower temperature. Thus the curled copying paper due to the water evaporation has been less likely to occur, and wrinkles on the copying paper has been eliminated because the stress of the copying paper due to the heat and pressure has been relieved.

(3) Since the copying paper is brought into contact with the heat fixing roller by low pressing force, an improved copying paper separability from the heat fixing roller can be obtained.

(4) Since it is possible to set the desired temperature of the heat fixing roller for obtaining the predetermined fixing strength, and since the copying paper is brought into contact with the heat fixing roller by low pressure, the anti-offset performance has been improved.

(5) Since it is possible to form the heat fixing roller out of a material with less pressure resistivity, the heat fixing roller can employ a thinner metal cylinder for the core. Thus it is possible to reduce the cost as well as to reduce the time required to warm up the electrophotographic copying apparatus.

(6) Since the nip width has been enlarged, the paper delivery property is further improved. Accordingly, it is not required to make the pressure roller a crown shape and a reverse-crown shape, which increase the cost of pressure roller, to improve the paper delivery property, and a fully favorable paper delivery is offered under the usual operating state. Namely, the paper delivery property of the pressure roller can be improved at a less cost by employing the present invention.

DETAILED DESCRIPTION OF THE PREFERRED EMBODIMENT

1. First Preferred Embodiment

The heat fixing unit in an electrophotographic copying apparatus according to the preferred embodiment of the present invention will be hereinafter explained with reference to FIGS. 1, 2, 3, 4 and 5.

The heat fixing unit in an electrophotographic copying apparatus according to the preferred embodiment has a heat fixing roller 30 and a pressure roller 40.

Figure 1:
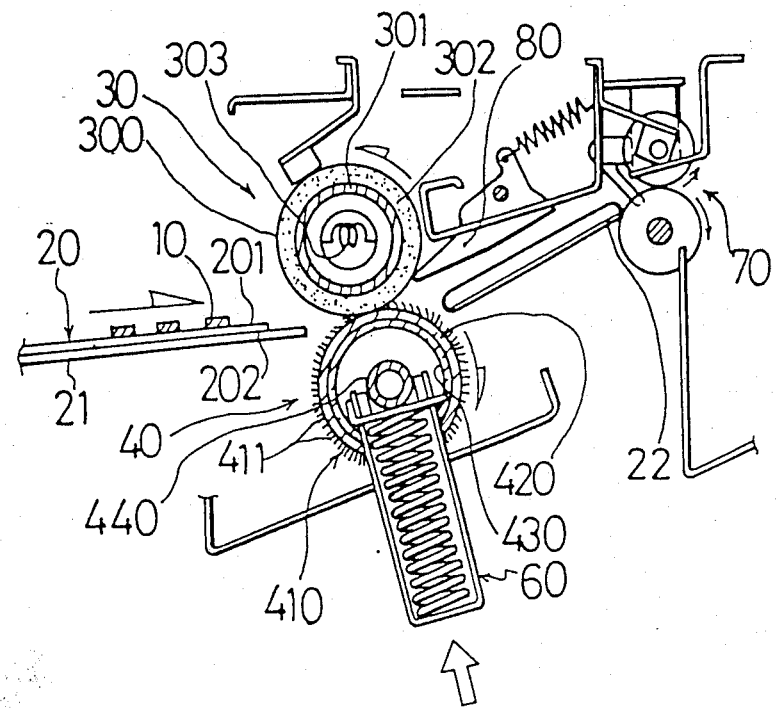
FIG. 1 is a side elevation view illustrating the major sections of a preferred embodiment of the present invention.
Figure 2:
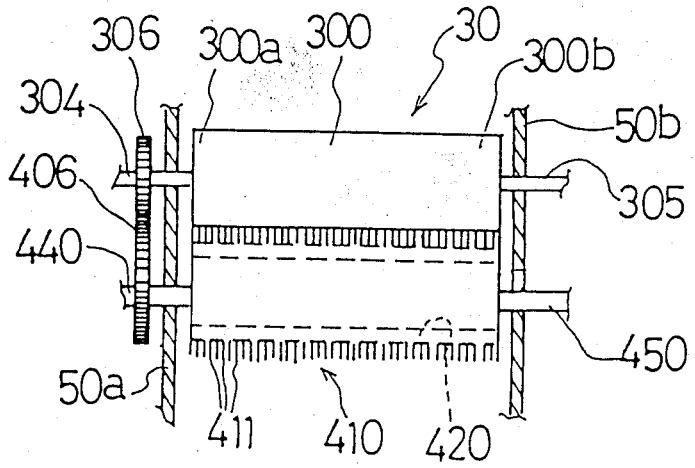
FIG. 2 is a front elevation view of the FIG. 1.

The heat fixing roller 30 may basically employ a conventional heat fixing roller. The heat fixing roller 30 and the pressure roller 40 nip and deliver a copying paper 20 carrying toner images 10. The heat fixing roller 30 heats and fuses the toner images 10 to fix them in the fibers of the copying paper 20. As shown in FIG. 1, the heat fixing roller has a metal core 301 such as an aluminum core, a teflon (a registered trade mark) layer 302 coated on the outer periphery thereof, and a heater 303 disposed inside thereof. As shown in FIG. 2, rotary shafts 304 and 305 are respectively installed on the both ends, 300*a* and 300*b*, of the heat fixing roller 30. The rotary shafts 304 and 305 are rotatably supported by retaining plates 50*a* and 50*b*. A driving gear 306 is installed on the rotary shaft 304, and is engaged with an actuator (not shown).

The periphery of the pressure roller 40 is formed of a brush 410 with a plurality of extending fibers 411. The brush 410 is formed of a plurality of teflon (a registered trade mark) fibers for instance. The brush 410 is formed of a flexible plate-shape substrate 420 with a plurality of flocked fibers. The pressure roller 40 is manufactured by winding the substrate 420 over the outer periphery of the cylinder shape aluminum core 430 and by applying an adhesive (not shown) therebetween to fix the substrate 420 on the aluminum core 430. Rotary shafts 440 and 450 are respectively installed on the both ends of the pressure roller 40. The rotary shafts 440 and 550 are rotatably supported by the retaining plates 50*a* and 50*b*. Thus the pressure roller 40 is rotatably supported while bringing the brush 410 into contact with the outer periphery of the heat fixing roller 30. A driven gear 406 interlocking with the driving gear 306 is installed on the rotary shaft 440. The pressure roller 40 is always brought into contact with the heat fixing roller 30 by the urging force of springs 60 working on the rotary shafts 440 and 450. The pressure roller 40 is brought into contact with the heat fixing roller by the total pressing force of 2 kgf.

Figure 3:
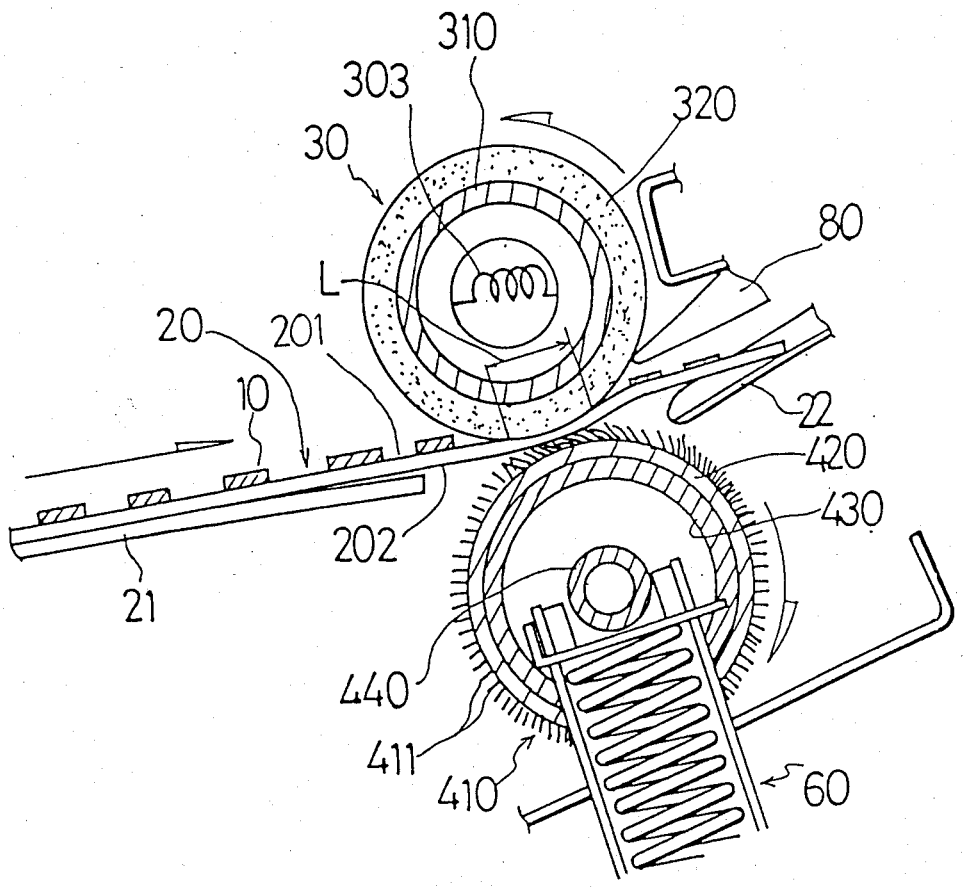
FIG. 3 is an enlarged view of the major sections of FIG. 1, and illustrates how a copying paper is nipped and delivered.

As shown in FIG. 3, the pressure roller 40 is brought into contact with a reverse surface 202 of the copying paper 20, and applies pressure to the copying paper 20 to have the other surface 201 of the copying paper 20 contacted with the heat fixing roller 30. Thus the nip width L of 12 mm is established in the preferred embodiment of the present invention constructed as explained above.

The operations of the preferred embodiment constructed as explained above will be hereinafter described.

The electrophotographic copying apparatus is first turned on to start the operations of the heat fixing unit. The toner images 10 are formed on the surface 201 of the copying paper 20 by the preceding process (not shown). The copying paper 20 is guided by a guide plate 21 as shown in FIG. 1. The copying paper 20 is nipped by the heat fixing roller 30 and the pressure roller 40, and is delivered by the same. The brush 410 of the pressure roller 40 is brought into contact with the reverse surface 202 of the copying paper 20, and applies pressure to the reverse surface 202 toward the heat fixing roller 30 by the elasticity of the brush 410 itself. Thus the surface 201 of the copying paper 20 is brought into contact with the heat fixing roller 30.

As the surface 201 of the copy paper 20 is brought into contact with the heat fixing roller 30, the toner images 10 formed on the surface 201 of the copying paper 20 are fused by the heat from the heat fixing roller 30, and the toner images 10 are fixed on the surface 201 of the copying paper 20 by the pressure exerted by the brush 410 of the pressure roller 40. Then the copying paper 20 is separated from the heat fixing roller 30 by separators 80. The bonding force between the copying paper 20 and the heat fixing roller 30 is reduced as compared with the conventional heat fixing unit, because the copying paper 20 is brought into contact with the heat fixing roller by the brush 410. As a result, the copying paper 20 is separated from the heat fixing roller with an increased separability. And the copying paper 20 is delivered to a tray (not shown) by a delivery unit 70 while being guided by a guide plate 22.

The preferred embodiment thus constructed has come to offer improved fixing and delivery performances compared with a comparative example described below.

Performance Evaluation 1

Performance evaluation comparing the performances of the pressure roller of the perferred embodiment explained above with those of the coventional pressure roller will be hereinafter explained.

The pressure roller of the preferred embodiment formed of the brush has 30 mm diameter, and is brought into contact with the heat fixing roller 30 by the total of 2 kgf pressing force. The fibers used to form the brush have 4 mm length, their sizes are 1200 denier, and the flocking density is 26 fibers per inch in the circumferential direction and 23 fibers per inch in the axial direction.

As for the comparative example, a conventional silicon rubber pressure roller formed of silicon rubber with the rubber hardness 40 degrees (thickness: 3 mm) is used. The silicon rubber pressure roller has 30 mm diameter, and is brought into contact with the heat fixing roller 30 by the total of 40 kgf pressing force.

Temperature Characteristic

Figure 4:
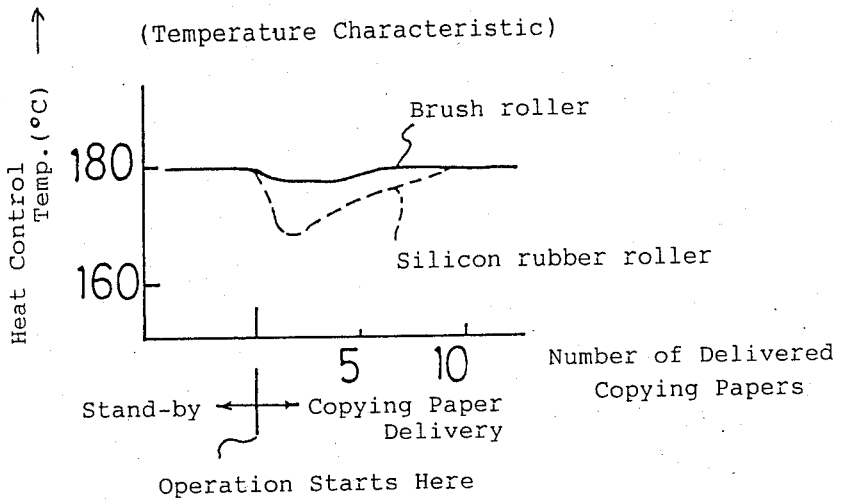
FIG. 4 is a graph comparing the temperature characteristic of a preferred embodiment of the present invention with that of a comparative example.

FIG. 4 illustrates the surface temperature changes of the heat fixing rollers after the heat fixing unit has been turned on. FIG. 4 also shows the temperature characteristic of the heat fixing roller in relation to the pressure roller of the preferred embodiment (hereinafter referred to as a brush roller), and the temperature characteristic of the heat fixing roller in relation to the pressure roller of the comparative example (hereinafter referred to as a silicon rubber roller). The difference in the temperature characteristics has arisen because the silicon rubber roller applies pressure to the heat fixing roller in the surface contact state with a larger contacting area, whereas the brush roller applies pressure to the heat fixing roller in the surface contact state with a less contacting area. Accordingly, the brush roller offers an advantage in stablizing the fixing property during the initial copying stage because the temperature drop in the surface of the heat fixing roller due to contact with the copying paper has been reduced. The temperature drop results from the heat conduction from the heat fixing roller to the pressure roller during the heat fixing unit start-up.

Fixing Performance

Figure 5:
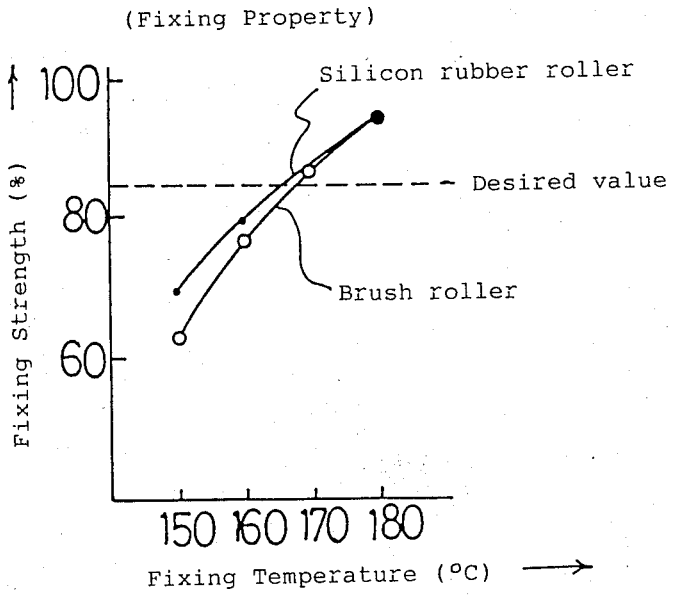
FIG. 5 is a graph comparing the fixing performance of a preferred embodiment of the present invention with that of a comparative example.

FIG. 5 is a graph illustrating the relationships between the fixing temperatures and the fixing strengths. The fixing strength is obtained by measuring the image density after rubbing the fixed standard image with the image density of 1.2 by a typewriter eraser; i.e.

$$\text{Fixing strength (\%)} = (\text{Image density after rubbing} / \text{image density before rubbing}) \times 100$$

The fixed standard image is rubbed by a typewriter eraser No. 502 having 15 mm width manufactured by Lion Jimuki Co., Ltd. The edge of the eraser is brought into contact with the fixed standard image at the angle of 45 degree by the total of 1 kgf pressing force, and is moved to-and-fro three times at the speed of 1 cm/sec. Approximately 170° C. fixing temperature is required for the case using the brush roller and the case using the silicon rubber roller to obtain the fixing strength of the desired value shown in FIG. 5. However, the desired fixing strength can be attained by the super low pressing force condition of total 2 kgf when the brush roller is used, whereas it can be attained by the pressing force condition of total 40 kgf when the silicon rubber roller is used. It is understood that a sufficient nip width has been obtained under the low pressing force condition by using the brush roller as the pressure roller. Approximately 12 mm nip width is obtained when the brush roller is used, whereas 4 mm nip width is obtained when the silicon rubber roller is used.

Paper Delivery Property

Since the stress of the copying paper resulting from the pressing force exerted on the copying paper between the heat fixing roller and the pressure roller has been relieved by the low pressing force condition, the degree of copying paper curling has been reduced when the brush roller is used. Further, even when an envelope is delivered, the brush roller has offered an advantage in stablizing the delivery; i.e. the number of wrinkles have been reduced.

Second Preferred Embodiment

Figure 6:
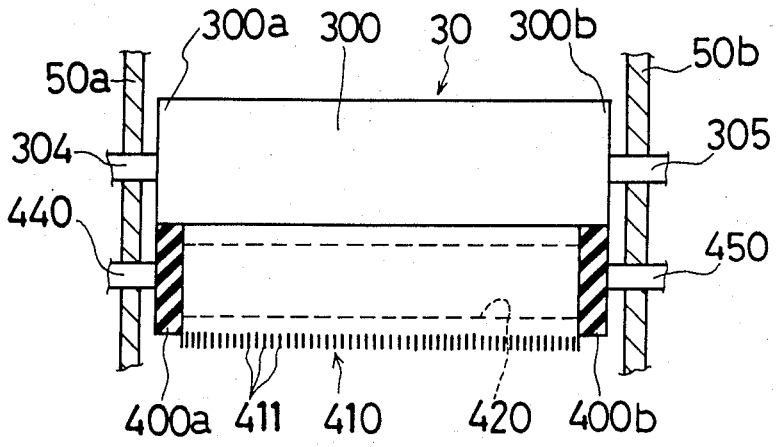
FIG. 6 is a front elevation view illustrating a second preferred embodiment of the present invention.

A modified embodiment employing driven ring components, disposed on both ends of the pressure roller, for transmitting the driving force from the heat fixing roller will be explained with reference to FIG. 6.

The heat fixing roller 30 will not be explained because it is identical with that of the aforementioned first preferred embodiment.

The pressure roller 40 will not be explained in detail because it is identical with that of the aforementionned first preferred embodiment except the employment of the driven ring components 400*a* and 400*b* disposed on the both ends thereof.

This modified embodiment employs ring shape friction components 400*a* and 400*b* on the both ends of the pressure roller 40 so as to make the diameter of the both ends slightly larger than that of the brush 410 contacting with the heat fixing roller 30. Thus the both ends of the pressure roller 40 are respectively brought into contact with the both ends, 300*a* and 300*b*, of the heat fixing roller 30 so that the pressure roller 30 is driven by the heat fixing roller 40.

Figure 7:
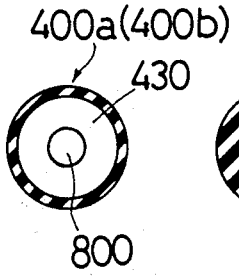
FIG. 7 is a cross-sectional view of a driven ring component and a pressure roller of the second preferred embodiment according to the present invention.

As shown in FIG. 7, the driven ring components 400*a* and 400*b* are formed of a resilient material which is wound on the outer periphery of the core 430 made of aluminum and the like, and are respectively installed on the both ends of the pressure roller 40 in this modified embodiment. 800 designates a shaft hole.

The heat fixing roller 30 and the driven ring components 400*a* and 400*b* installed on the both ends of the pressure roller 40 frictionally contact according to the aforementioned construction. The rotation of the heat fixing roller 30 drives the driven ring components 400*a* and 400*b* to rotate, and the pressure roller 40 rotates around the rotary shafts 440 and 450. At the same time, the driven ring components 400*a* and 400*b* are depressed by a prescribed amount when they are brought into contact with the heat fixing roller 30, because they are formed of a resilient material. Accordingly, the height of brush 410 can be controlled by controlling the depression amount.

Figure 8:
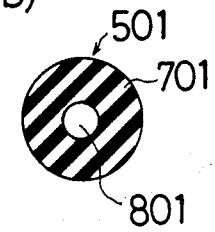
FIG. 8 is a cross-sectional view of a driven ring component and a pressure roller of the second preferred embodiment according to the present invention.
Figure 9:
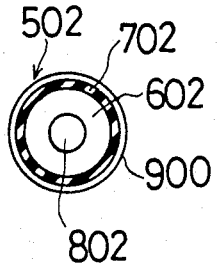
FIG. 9 is a cross-sectional view of a driven ring component and a pressure roller of the second preferred embodiment according to the present invention.

As shown in FIG. 8, the driven ring components may be integrally formed of a resilient material in the aforementioned modified embodiment. Furthermore, as shown in FIG. 9, the pressure roller of this modified embodiment may comprise a core 602 with a pair of shaft holes 802, a pair of resilient components 702 wound on each of the outer periphery of the both end portions of the core 602, a protective layer 900 having a good heat resistance property and separability disposed outside of each of the resilient components 702.

Performance Evaluation 2

The dependence of the depression amount on the types of the resilient components forming the driven ring components 400*a* and 400*b*, and on various pressure has been evaluated under the following conditions:

Heat fixing roller:
- 25 mm diameter teflon (registered trade mark) roller

Pressure roller:
- 25 mm diameter brush roller with 19 mm diameter core;
- fiber length: 3 mm;
- fiber size: 1200 denier;
- flocking density: 23 fibers per inch in the axial direction and 26 fibers per inch in the circumferential direction Driven ring component:
- Diameter: 25 mm;
- Thickness: 5 mm;
- Ring width: 7.5 mm Driven ring component materials:
- A: Foamed silicon with 25 degrees by asker rubber hardness tester
- B: Foamed silicon with 40 degrees by asker rubber hardness tester
- C: Low temperature vulcanization rubber with 10 degrees by JIS "A" rubber hardness tester D: Low temperature vulcanization rubber with 10 degrees by JIS "A" rubber hardness tester
E: Aluminum

TABLE 1

| | Pressing Force (kgf/cm) and the Depression Amount of Driven Ring Components (mm) | | | |
|---|---|---|---|---|
| | Pressing Force | 0.23 | 0.5 | 1 |
| Driven Ring Component | A | 0.7 | 1.1 | 2.2 |
| | B | 0.4 | 0.9 | 1.7 |
| | C | 0.3 | 0.7 | 1.3 |
| | D | 0 | 0 | 0.4 |
| | E | 0 | 0 | 0 |

The data listed in Table 1 have been obtained by using the aforementioned heat fixing roller, pressure roller and driven ring components.

The hatched area in Table 1 show that it is impossible to rotate the pressure roller 40 frictionally when the driven ring components are formed of the materials listed in the table.

Results

As shown in the Table 1, it has been found that the height of the brush and the contacting width with the heat fixing roller can be varied under a constant pressure by changing the materials forming the driven ring components.

Further, as designated by "E" in Table 1, namely in case the pressure roller employs the driven ring components formed of a hard material such as aluminum and the like, the pressure roller can be driven by the heat fixing roller only when a high pressure is applied.

It is impossible to have the driven ring components of the hatched area of the table rotated as aforementioned.

Performance Evaluation 3

The relationship between the pressing force of the pressing roller 40 in relation to the heat fixing roller and the nip width in the heat fixing unit of the second preferred embodiment has been evaluated under the following conditions. For the driven ring components, the driven ring components constructed according to FIG. 8 has been used for the performance evaluation.

Heat fixing roller:

25 mm diameter teflon (registered trade mark) roller

Pressure roller:

30 mm diameter brush roller with 24 mm diameter core;
fiber length: 3 mm;
fiber size: 10 denier;
fiber material: Aromatic polyamide Driven ring component; material: Low temperature vulcanization rubber with 10 degrees by JIS "A" rubber hardness tester Ring width: 7.5 mm Diameter;

A: 28 mm diameter
B: 27 mm diameter
C: 26 mm diameter
D: No driven ring component Further "E" designates a comparative example. A pressure roller of 30 mm diameter having a silicon rubber over the core has been used for a comparative example. The thickness of the silicon rubber is 5 mm and the rubber hardness is TISA 40 degrees.

The evaluation has been performed by using the four brush rollers and the one silicon rubber roller. The results are shown in FIG. 10.

Figure 10:
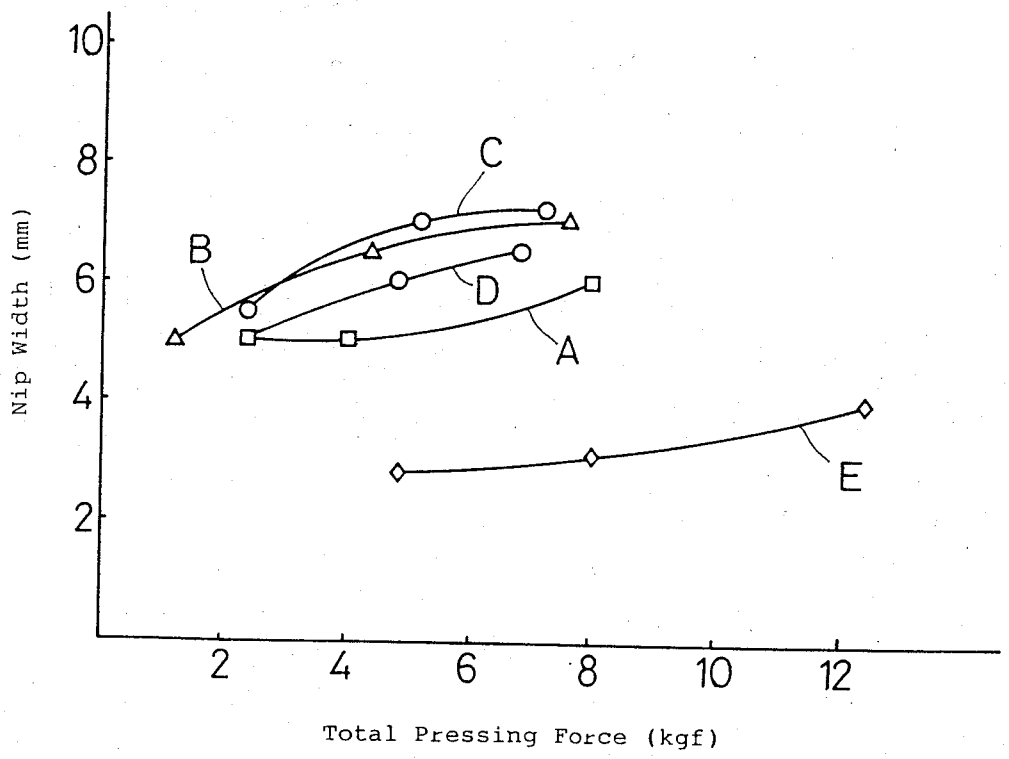
FIG. 10 is a graph showing the relationship between the pressing force of the pressure roller in relation to the heat fixing roller and the nip width.

As can be seen from FIG. 10, the brush rollers A, B, C and D have offered larger nip widths than the silicon rubber roller E, and it has been possible to obtain the nip width of 5 mm of more under lower pressure by using a brush roller.

Further, the nip width has decreased even when the brush extending amount over the diameter of the driven components was increased, because the strength of the copying paper has overcome the brush extending amount. The widest nip width has been obtained when the brush extending amount is 1.5 to 2.0 mm.

Performance Evaluation 4

Figure 11:
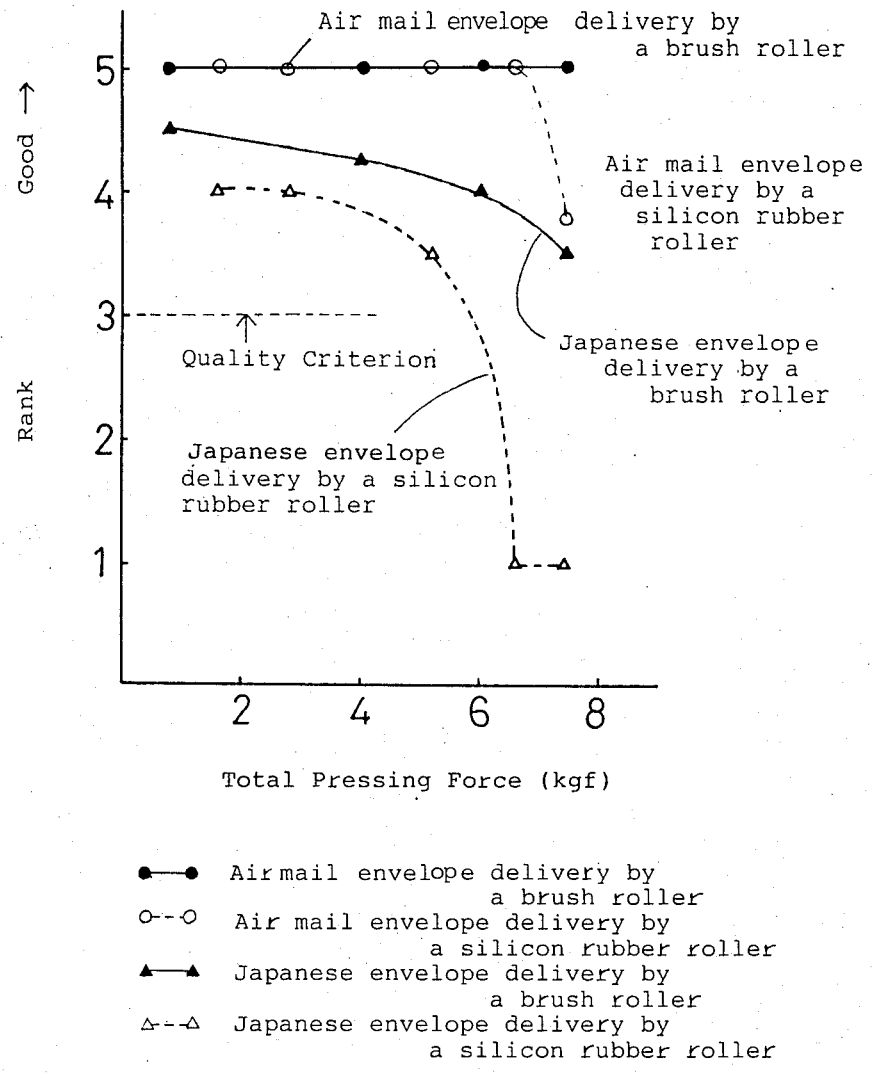
FIG. 11 is a graph showing the relationship between the pressing force of the pressure roller in relation to the heat fixing roller and the envelope delivery.

The relationship between the pressing force of the pressure roller 40 in relation to the heat fixing roller 30 and the envelope delivery property has been evaluated. The results are shown in FIG. 11. The brush roller A of the performance evaluation 3 has been used for the pressure roller of a preferred embodiment, and the silicon rubber E of the performance evaluation 3 has been used for the pressure roller of a comparative example.

Following two types of envelopes have been used in the evaluation.

| | Size | Weight of Unit Area |
|---|---|---|
| Japanese envelope | 90 mm × 205 mm | 90 g/m$^2$ |
| Air mail envelope | 105 mm × 233 mm | 75 g/m$^2$ |

The delivery property has been evaluated according to the following evaluation table. The number of wrinkles induced by the fixing operation have been checked visually.

| Rank | Number of Wrinkles | Usability |
|---|---|---|
| 1 | Many | No |
| 2 | Rather many | No |
| 3 | Medium | Yes |
| 4 | A little | Yes |
| 5 | None | Yes |

As can be seen from FIG. 11, the brush roller A is usable under the total pressing force of 8 kgf or less, but the silicon rubber roller E shows less delivery property under the total pressing force of 6 kgf or more.

Performance Evaluation 5

The relationship between the pressing force of the pressure roller 40 in relation to the heat fixing roller 30 and the fixing strength has been evaluated. The brush roller A of the performance evaluation 3 has been used for the pressure roller of a preferred embodiment, and the silicon rubber E of the performance evaluation 3 has been used for the pressure roller of a comparative example.

The fixing speed is set at 70 mm/sec., and the fixing temperature is set at 185° C. in the evaluation.

Figure 12:
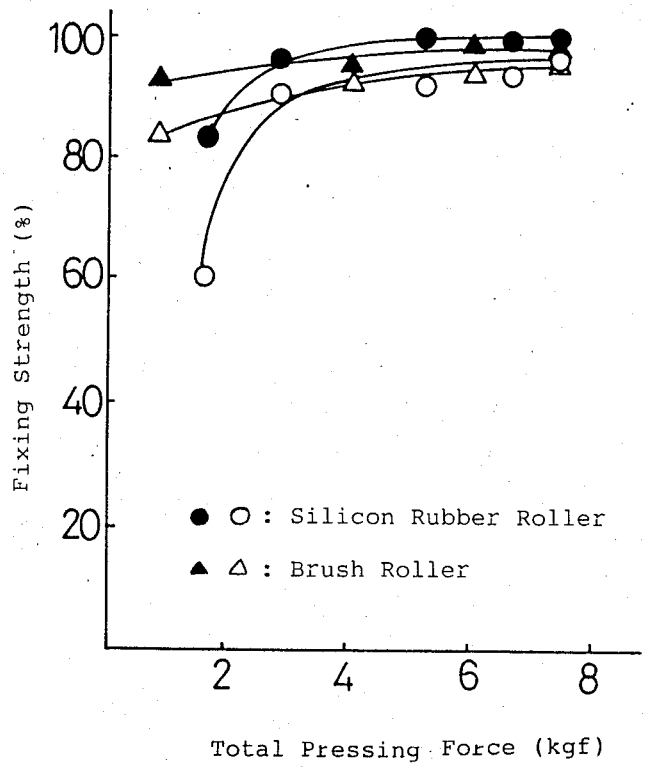
FIG. 12 is a graph showing the relationship between the pressing force of the pressure roller in relation to the heat fixing roller and the fixing strength on a high quality paper.
Figure 13:
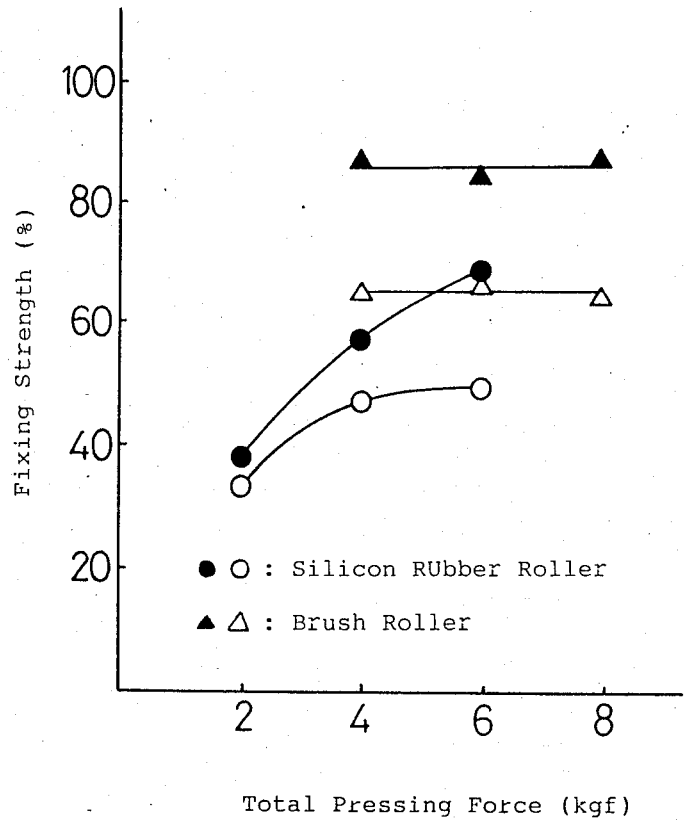
FIG. 13 is a graph showing the relationship between the pressing force of the pressure roller in relation to the heat fixing roller and the fixing strength on a letter paper with letter head.

The following two types of papers have been delivered in the heat fixing units. FIG. 12 shows the results when the high quality paper is delivered. Fig. 13 shows the results when the letter paper with letterhead is delivered.

| | Paper Thickness | Flatness | Weight of unit area |
|---|---|---|---|
| High Quality Paper | 83 μm | 30 mmHg | 64 g/m$^2$ |
| Letter Paper with Letter Head | 150 μm | 730 mmHg | 88 g/m$^2$ |

The measurement method of the fixing strength is as explained in the section of Performance Evaluation 1. In FIGS. 12 and 13, the blank circles and triangles designate the cases in which the image density before rubbing is 0.6, the solid circles and triangles designate the cases in which the image density before rubbing is 1.2.

As can be seen from FIGS. 12 and 13, in case the brush roller A has been used, the fixing property was not liable to change when the pressing force fluctuates. Thus good fixing properties have been obtained always.

The heat fixing unit according to the present invention may further employ a curing means for raising the brush disposed on the pressure roller. The curing means may either be a fixed type shown in FIG. 14 or a rotary type shown in FIG. 15.

Figure 14:
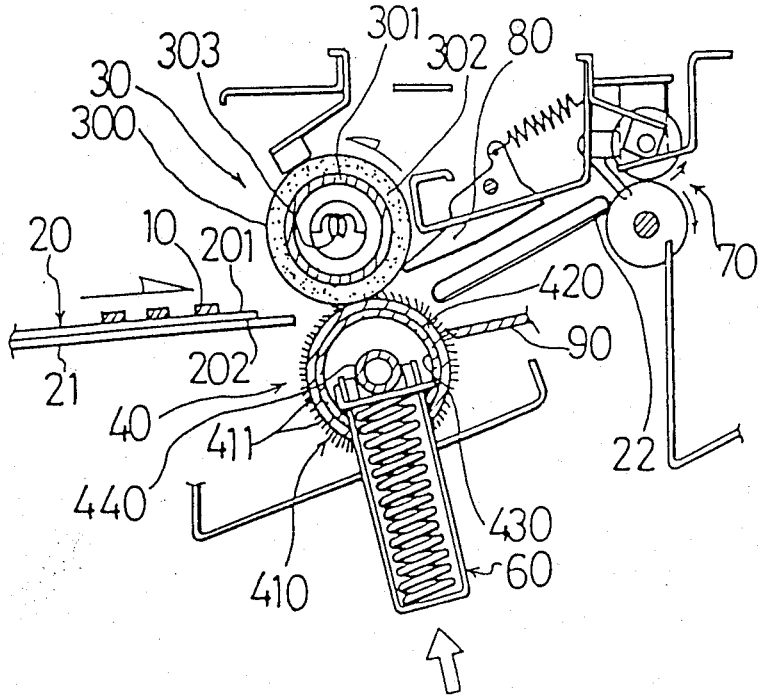
FIG. 14 is a side elevation view illustrating a preferred embodiment of the present invention employing a fixed type curing means.

In FIG. 14, the curing component 90 is a plate shape component disposed longitudinally along the axis of the pressure roller 40. The curing component 90 is fixed to a heat fixing unit casing, and is in parallel to the pressure roller 40 while its tip edge contacts with the brush of the pressure roller 40.

The curing component 90 thus constructed compulsorily raises the brush 410 having contacted with the heat fixing roller 30 to the original angle when the brush 410 of the pressure roller 40 being always brought into contact with the heat fixing roller 30 has been inclined in one direction and the inclined angle of the brush 410 has been increased gradually. Thus the brush 410 can always apply a stable pressing force to the heat fixing roller 30. Accordingly, the pressing force exerted to the copying paper which is nipped and delivered between the heat fixing roller 30, has come to be stabilized.

Figure 15:
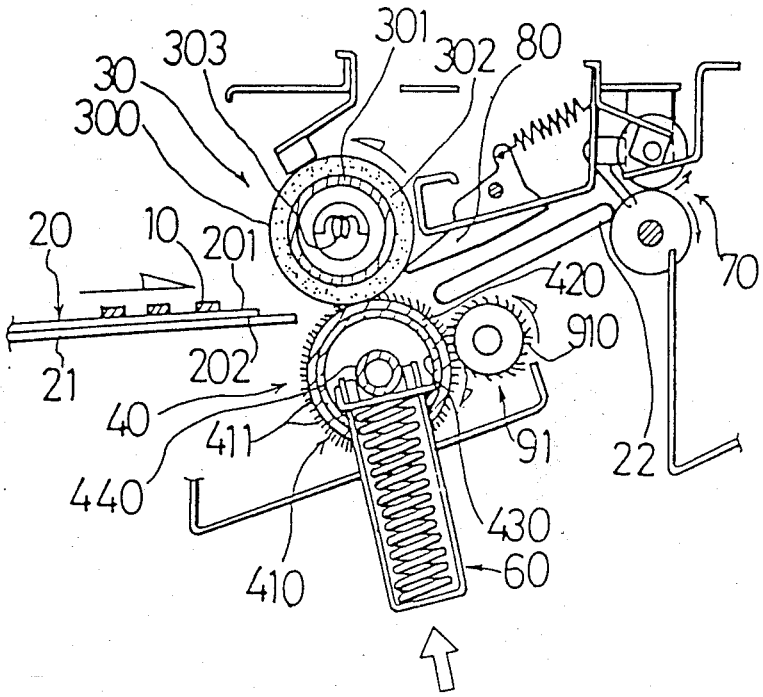
FIG. 15 is a side elevation view illustrating a preferred embodiment of the present invention employing a rotary type curring means.
Figure 16:
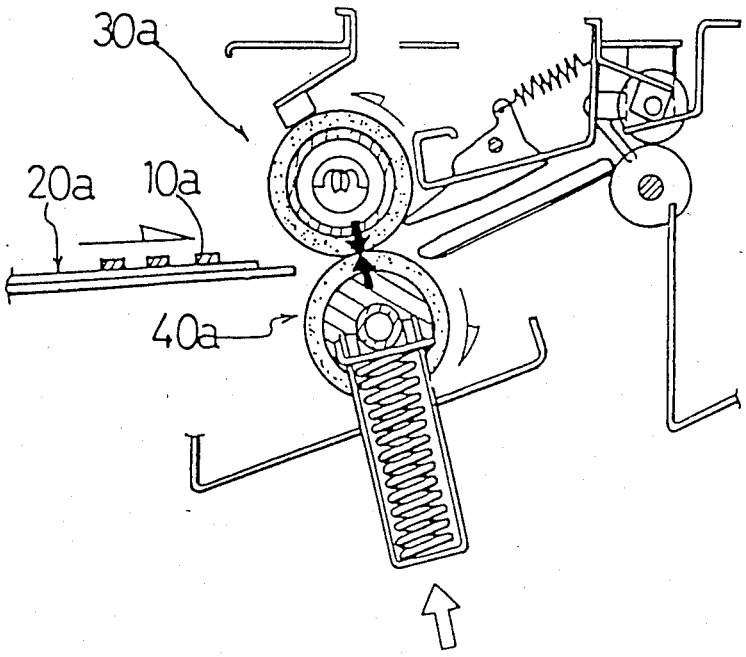
FIG. 16 is a side elevation view illustrating a conventional heat fixing unit.

The curing roller 91, shown in FIG. 15, has a rigid brush 910 on the periphery thereof. The curing roller 91 is driven at a speed faster than the periphery speed of the pressure roller 40 in the direction opposite to the rotation of the pressure roller 40 while being in contact with the brush 410 of the pressure roller 40. The curing roller 91 thus constructed compulsorily raises the brush 410 having contacted with the heat fixing roller 30 to the original angle when the brush 410 of the pressure roller 40 being always brought into contact with the heat fixing roller 30 has been inclined in one direction and the inclined angle of the brush 410 has been increased gradually. Thus the brush 410 can always apply a stable pressing force to the heat fixing roller 30.

What is claimed is:

1. A heat fixing device used in an electrophotographic recording apparatus comprising:

a rotatable heat roller having heating means:

a rotatable pressure roller having a core and a plurality of fibers disposed on the periphery surface of said core; and rings provided on the both ends of said pressure roller so as to contact with said heat roller and comprising a resilient material for preventing the slip with respect to said heat roller.

2. A heat fixing device according to claim 1, wherein the outer diameter of said rings is identical with the outer diameter of said pressure roller.

3. A heat fixing device according to claim 1, wherein said pressure roller is driven by said heat roller through said rings.

4. A heat fixing device according to claim 1, wherein said plurality of fibers are formed of a metal, an aromatic polyamide resin or a fluoro resin.

5. A heat fixing device according to claim 1, wherein said plurality of fibers are formed of a metal coated with an agent offering a good separability.

6. A heat fixing device according to claim 1, wherein said plurality of fibers are formed of a conductive material.

7. A heat fixing device used in an electrophotographic recording apparatus comprising:

a rotatable heat roller having heating means:

a rotatable pressure roller disposed in contact with said heat roller and having a core and a plurality of fibers provided on the periphery surface of said core;

means for adjusting the contact width between said heat roller and said pressure roller; and a curing means contacting with the periphery surface of said pressure roller for raising said plurality of fibers.

8. A heat fixing device according to claim 7, wherein said curing means is a plate shape component disposed in parallel to said pressure roller.

9. A heat fixing device according to claim 7, wherein said curing means is a curing roller rotating at a faster speed than the speed of said pressure roller in the direction opposite to the rotating direction of said pressure roller.

10. A heat fixing device according to claim 9, wherein said curing means has a plurality of fibers.

* * * * *